US009766565B2

(12) United States Patent
Oki et al.

(10) Patent No.: US 9,766,565 B2
(45) Date of Patent: Sep. 19, 2017

(54) LIQUID DEVELOPER AND DEVELOPER CARTRIDGE

(71) Applicant: FUJI XEROX CO., LTD., Tokyo (JP)

(72) Inventors: Masahiro Oki, Kanagawa (JP); Koji Horiba, Kanagawa (JP); Takako Kobayashi, Kanagawa (JP); Akira Imai, Kanagawa (JP); Yoshitake Ogura, Kanagawa (JP); Hiroyuki Moriya, Kanagawa (JP); Daisuke Yoshino, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/235,896

(22) Filed: Aug. 12, 2016

(65) Prior Publication Data

US 2017/0235242 A1 Aug. 17, 2017

(30) Foreign Application Priority Data

Feb. 12, 2016 (JP) ..... 2016-024528

(51) Int. Cl.

| | |
|---|---|
| ***G03G 9/13*** | (2006.01) |
| ***G03G 9/087*** | (2006.01) |
| ***G03G 15/10*** | (2006.01) |
| ***G03G 9/125*** | (2006.01) |

(52) U.S. Cl.

CPC ..... *G03G 9/08786* (2013.01); *G03G 9/08795* (2013.01); *G03G 9/08797* (2013.01); *G03G 9/125* (2013.01); *G03G 9/133* (2013.01); *G03G 15/10* (2013.01)

(58) Field of Classification Search

CPC ..... G03G 9/132

See application file for complete search history.

(56) References Cited

U.S. PATENT DOCUMENTS

2014/0370436 A1 12/2014 Yoshie et al.

FOREIGN PATENT DOCUMENTS

| | | | |
|---|---|---|---|
| JP | S49-91231 | A | 8/1974 |
| JP | S56-40868 | A | 4/1981 |
| JP | 2008-203736 | A | 9/2008 |
| JP | 2008-209489 | A | 9/2008 |
| JP | 5277677 | B2 | 8/2013 |
| JP | 2013-205622 | A | 10/2013 |
| JP | 2015-001712 | A | 1/2015 |

*Primary Examiner* — Hoa V Le

(74) *Attorney, Agent, or Firm* — Oliff PLC

(57) ABSTRACT

A liquid developer includes a carrier liquid and a toner including a urethane-modified acrylic resin.

18 Claims, 1 Drawing Sheet

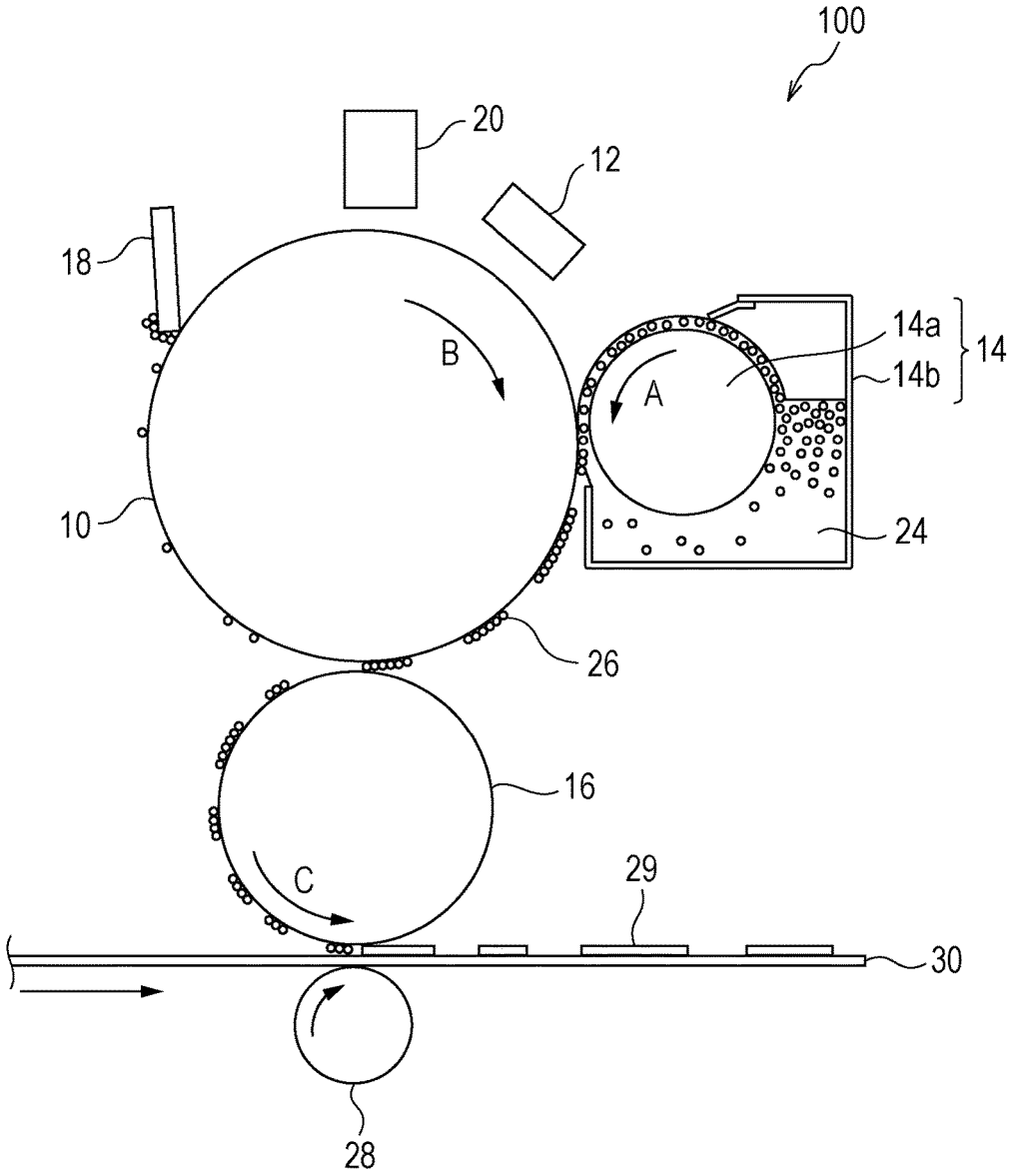
100
20
12
18
B
14a
14
14b
A
10
24
26
16
C
29
30
28

LIQUID DEVELOPER AND DEVELOPER CARTRIDGE

CROSS-REFERENCE TO RELATED APPLICATIONS

This application is based on and claims priority under 35 USC 119 from Japanese Patent Application No. 2016-024528 filed Feb. 12, 2016.

BACKGROUND (i) Technical Field

The present invention relates to a liquid developer and a developer cartridge.

(ii) Related Art

Methods for visualizing image information via the formation of an electrostatic image, such as electrophotography, have been used in various fields. In electrophotography, a latent image (i.e., an electrostatic latent image) is formed on an image carrier in charging and exposure steps (i.e., a latent-image forming step; the electrostatic latent image is developed with an electrostatic-image developer (hereinafter, referred to simply as "developer") including an electrostatic-image developing toner (hereinafter, referred to simply as "toner") in a developing step; and the developed toner image is visualized in transfer and fixing steps. Examples of developers that may be used in dry development include a two-component developer composed of a toner and a carrier and a one-component developer composed of only a magnetic toner or a non-magnetic toner.

Liquid developers used in wet development are produced by dispersing toner particles in an insulating carrier liquid. Known examples of such liquid developers include a liquid developer that includes a volatile carrier liquid in which toner particles each including a thermoplastic resin are dispersed and a liquid developer that includes a low-volatile carrier liquid in which toner particles each including a thermoplastic resin are dispersed.

SUMMARY

According to an aspect of the invention, there is provided a liquid developer including a carrier liquid and a toner including a urethane-modified acrylic resin.

BRIEF DESCRIPTION OF THE DRAWINGS

Exemplary embodiments of the present invention will be described in detail based on the following FIGURE, wherein:

FIG. 1 is a schematic diagram illustrating an example of an image forming apparatus according to an exemplary embodiment of the invention.

DETAILED DESCRIPTION

Exemplary embodiments are described below.

(1) Liquid Developer

A liquid developer according to an exemplary embodiment includes a carrier liquid and a toner that includes a urethane-modified acrylic resin.

Adding a urethane resin to a toner included in a liquid developer may improve the adhesion of images formed with the liquid developer to recording media. However, the inventors of the invention found that the flexibility of the urethane resin may reduce ease of pulverizing toner particles in the preparation of the developer and, as a result, a reduction in the diameter of toner particles may be limited.

The inventors conducted detailed studies and, as a result, found that a liquid developer including a carrier liquid and a toner including a urethane-modified acrylic resin enables images having high adhesion to recording media to be formed and increases ease of pulverizing toner particles.

The liquid developer according to this exemplary embodiment is described below in detail.

Toner

The liquid developer according to this exemplary embodiment includes a toner including a urethane-modified acrylic resin.

The liquid developer according to this exemplary embodiment may include only one toner or two or more toners.

The liquid developer according to this exemplary embodiment may include a toner that does not include a urethane-modified acrylic resin. In such a case, the content of the toner including a urethane-modified acrylic resin in the liquid developer according to this exemplary embodiment is preferably 50% by weight or more, is more preferably 90% by weight or more, and is particularly preferably 95% by weight or more of the total amount of the toner included in the liquid developer.

Urethane-Modified Acrylic Resin

The urethane-modified acrylic resin used in this exemplary embodiment is a resin constituted by a urethane resin component and an acrylic resin component (i.e., an acrylic component) that are chemically bonded to each other.

Since the urethane-modified acrylic resin is a resin constituted by a urethane resin component and an acrylic resin component that are chemically bonded to each other, it is possible to readily control the desired physical properties of the toner or the like by changing the compositional ratio between the urethane resin component and the acrylic resin component.

With the liquid developer according to this exemplary embodiment including a toner including a urethane-modified acrylic resin, images having high adhesion to recording media may be formed. Furthermore, ease of pulverizing toner particles, a developing property, a positively charging property, and preservation stability may be enhanced.

The urethane resin component (hereinafter, referred to as "urethane portion" or "urethane chain") and the acrylic resin component (hereinafter, referred to as "acrylic portion" or "acrylic chain") of the urethane-modified acrylic resin used in this exemplary embodiment may be bonded to each other in the manner of a block copolymer or a graft copolymer.

In particular, in this exemplary embodiment, the urethane-modified acrylic resin is preferably a graft polymer of an acrylic resin and a urethane resin and is more preferably a graft polymer of an acrylic resin and a polyester urethane resin.

In the graft polymer of an acrylic resin and a urethane resin, the urethane chain may be bonded to a side chain of the acrylic resin.

Examples of an acrylic monomer constituting the acrylic portion of the urethane-modified acrylic resin include (meth) acrylates, (meth)acrylonitriles, and (meth)acrylamides. The acrylic portion may be a copolymer of the acrylic monomer with a monomer such as a styrene, a vinyl compound, or a maleic acid compound.

Specific examples of the acrylic monomer include methyl (meth)acrylate, ethyl (meth)acrylate, isobutyl (meth)acrylate, n-butyl (meth)acrylate, glycidyl (meth)acrylate, (meth) acrylonitrile, and (meth)acrylamide.

Specific examples of the monomer capable of copolymerizing with the acrylic monomer include styrene, vinyl acetate, vinyl chloride, maleic acid, and the derivatives of maleic acid.

The monomer constituting the acrylic portion may include a reactive group capable of bonding to the urethane portion.

The reactive group included in the acrylic portion is not limited and may be any reactive group capable of bonding to the urethane portion, such as a hydroxyl group or an amino group. In particular, the reactive group included in the acrylic portion may be a hydroxyl group.

Specific examples of monomers including the reactive group include 2-hydroxypropyl (meth)acrylate and 2-hydroxyethyl (meth)acrylate.

The acrylic portion of the urethane-modified acrylic resin may be linear. In other words, the acrylic portion may be a monofunctional ethylene compound. In such a case, the urethane portion of the urethane-modified acrylic resin may be one or more side chains of the acrylic portion or constitute the backbone of the urethane-modified acrylic resin together with the acrylic portion.

The glass-transition temperature (Tg) of the acrylic portion of the urethane-modified acrylic resin is preferably 20° C. to 85° C. and is more preferably 50° C. to 85° C. in order to form images having higher adhesion to recording media and further increase ease of pulverizing toner particles.

The content of the acrylic portion of the urethane-modified acrylic resin is preferably 10% to 90% by weight, is more preferably 30% to 90% by weight, is further preferably 50% to 90% by weight, and is particularly preferably 50% to 85% by weight of the total amount of the urethane-modified acrylic resin in order to form images having higher adhesion to recording media, further increase ease of pulverizing toner particles, and enhance the stability with which toner particles are dispersed in the liquid developer.

Examples of monomers constituting the urethane portion of the urethane-modified acrylic resin include polyfunctional alcohols and polyfunctional isocyanates.

The urethane portion of the urethane-modified acrylic resin is preferably linear and is more preferably a bifunctional alcohol or a bifunctional isocyanate.

The polyfunctional alcohols and the polyfunctional isocyanates are not limited, and polyfunctional alcohols and polyfunctional isocyanates known in the related art may be used.

The urethane portion preferably includes a polyether structure, a polyester structure, and/or a polyolefin structure, more preferably includes a polyether structure and/or a polyester structure, and particularly preferably includes a polyester structure in order to form images having higher adhesion to recording media and further increase ease of pulverizing toner particles.

For introducing the polyether structure, the polyester structure, or the polyolefin structure into the urethane portion, polyether polyol, polyester polyol, and polyolefin polyol are preferably used, and polyether diol, polyester diol, and polyolefin diol are more preferably used.

The urethane portion may further include a urea bond.

The content of the urethane portion of the urethane-modified acrylic resin is preferably 10% to 90% by weight, is more preferably 10% to 70% by weight, is further preferably 10% to 50% by weight, and is particularly preferably 15% to 50% by weight of the total amount of the urethane-modified acrylic resin in order to form images having higher adhesion to recording media, further increase ease of pulverizing toner particles, and enhance the stability with which toner particles are dispersed in the liquid developer.

The weight ratio of the urethane portion to the acrylic portion of the urethane-modified acrylic resin (urethane portion/acrylic portion) is preferably 10/90 to 70/30, is more preferably 10/90 to 50/50, and is particularly preferably 15/85 to 50/50 in order to form images having higher adhesion to recording media, further increase ease of pulverizing toner particles, and enhance the stability with which toner particles are dispersed in the liquid developer.

The weight-average molecular weight of the urethane-modified acrylic resin is preferably 5,000 to 200,000, is more preferably 10,000 to 100,000, is further preferably 20,000 to 80,000, and is particularly preferably 25,000 to 60,000 in order to form images having higher adhesion to recording media and further increase ease of pulverizing toner particles.

Only one urethane-modified acrylic resin may be used alone. Alternatively, two or more urethane-modified acrylic resins may be used in combination.

The content of the urethane-modified acrylic resin is preferably 1% to 50% by weight, is more preferably 5% to 40% by weight, is further preferably 8% to 35% by weight, is particularly preferably 10% to 30% by weight, and is most preferably 15% to 25% by weight of the total amount of the toner in order to form images having higher adhesion to recording media, further increase ease of pulverizing toner particles, and enhance the stability with which toner particles are dispersed in the liquid developer.

A method for producing the urethane-modified acrylic resin is not limited, and known method for producing a urethane-modified acrylic resin may be employed. In particular, the following production method may be employed.

Specifically, the urethane-modified acrylic resin may be readily produced by, for example, preparing an acrylic resin including a hydroxyl group from a (meth)acrylate including a reactive group, such as 2-hydroxypropyl (meth)acrylate or 2-hydroxyethyl (meth)acrylate, and causing the acrylic resin including a hydroxyl group ($HO—R^2$) to react with a urethane resin including an isocyanate group at one terminal ($R^1—NCO$) as represented by the reaction formula below,

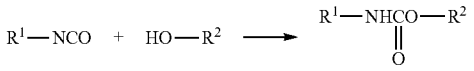

where $R^1$ represents the urethane portion and $R^2$ represents the acrylic portion.

Other Binder Resin

The toner may include a binder resin other than the above-described urethane-modified acrylic resin. Examples of the other binder resin include, but are not limited to, homopolymers of the following monomers, copolymers of two or more of the following monomers, and mixtures thereof: styrenes such as styrene, para-chlorostyrene, and α-methylstyrene; esters including a vinyl group, such as methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, and 2-ethylhexyl methacrylate; vinyl nitriles such as acrylonitrile and methacrylonitrile; vinyl ethers such as vinyl methyl ether and vinyl isobutyl ether; vinyl ketones such as vinyl methyl ketone, vinyl ethyl ketone, and vinyl isopropenyl ketone; and polyolefins such as ethylene, propylene, and butadiene. Examples of the other binder resin also include non-vinyl resins such as an epoxy resin, a polyester resin, a polyurethane resin, a polyamide resin, a cellulose resin, and a polyether resin; mixtures of the above non-vinyl resins and the above vinyl resins; and graft polymers produced by polymerization of the vinyl monomer in the presence of the non-vinyl resins and the vinyl resins.

The above other binder resins may be used alone or in combination of two or more.

Among the above other binder resins, in particular, a polyester resin and a styrene-acrylic resin are preferably added to the toner and a polyester resin is more preferably added to the toner in order to form images having higher adhesion to recording media and further increase ease of pulverizing toner particles.

The content of the other binder resin is preferably 10% to 95% by weight, is more preferably 50% to 90% by weight, and is particularly preferably 60% to 85% by weight of the total amount of the toner in order to form images having higher adhesion to recording media, further increase ease of pulverizing toner particles, and enhance developing property.

The total content of the urethane-modified acrylic resin and the other binder resin is preferably 70% to 99% by weight and is more preferably 80% to 95% by weight of the total amount of the toner in order to form images having higher adhesion to recording media, further increase ease of pulverizing toner particles, and enhance developing property.

Additive

The toner may optionally include an additive.

The additive is not limited, and known toner additives such as a colorant, a parting agent, and inorganic particles may be used. These additives may be internally added to toner particles or externally added to toner particles through a mixing treatment subsequent to the formation of the toner particles.

The colorant is not limited, and known pigments may be used. The colorant may optionally include a known dye. Specific examples of the colorant include the following yellow, magenta, cyan, and black pigments.

Examples of the yellow pigments include condensed azo compounds, isoindolinones, anthraquinones, azo metal complex compounds, methines, and arylamides.

Examples of the magenta pigments include condensed azo compounds, diketopyrrolopyrroles, anthraquinones, quinacridones, lakes of basic dyes, naphthols, benzimidazolones, thioindigo compounds, and perylenes.

Examples of the cyan pigments include copper phthalocyanines and the derivatives thereof; anthraquinones; and lakes of basic dyes.

Examples of the black pigments include carbon black, aniline black, acetylene black, and iron black.

The content of the colorant is preferably 0.5% to 25% by weight and is more preferably 5% to 20% by weight of the total amount of the toner.

Examples of the parting agent include, but are not limited to, vegetable waxes such as a carnauba wax, a Japan wax, and a rice bran wax; animal waxes such as a beeswax, an insect wax, a spermaceti wax, and a wool wax; mineral waxes such as a montan wax and ozokerite; solid synthesized fatty acid ester waxes including an ester at the side chain, such as a Fischer-Tropsch (FT) wax, specialty fatty acid esters, and polyhydric alcohol esters; and synthetic waxes such as a paraffin wax, a polyethylene wax, a polypropylene wax, a polytetrafluoroethylene wax, a polyamide wax, and a silicone compound.

The above parting agents may be used alone or in combination of two or more.

The content of the parting agent may be 0.1% to 10% by weight of the total amount of the toner.

Examples of the inorganic particles include, but are not limited to, particles of a metal oxide.

Examples of the metal oxide include titanium oxide, aluminium oxide, magnesium oxide, zinc oxide, strontium titanate, barium titanate, magnesium titanate, and calcium titanate.

Only one type of inorganic particles may be used alone. Alternatively, two or more types of inorganic particles may be used in combination.

The content of the inorganic particles added to the toner may be 0.1% to 10% by weight of the total amount of the toner.

Method for Producing Toner

A method for producing the toner used in this exemplary embodiment is not limited. The toner used in this exemplary embodiment may be readily produced by, for example, forming toner particles by a method for producing a pulverized toner, a liquid-emulsification-dried toner, or a polymerized toner, or the like and pulverizing the toner particles in a carrier liquid.

Specifically, the pulverized toner is prepared by, for example, mixing a binder resin and, as needed, additives such as a colorant with each other in a Henschel mixer or the like, melt-kneading the resulting mixture with a twin-screw extruder, a Banbury mixer, a roll mill, a kneader, or the like, cooling the kneaded mixture with a drum flaker or the like, crushing the kneaded mixture into coarse particles with a pulverizer such as a hammer mill, pulverizing the coarse particles with a pulverizer such as a jet mill, and classifying the resulting particles with a wind classifier or the like.

The liquid-emulsification-dried toner is prepared by, for example, dissolving a binder resin and, as needed, additives such as a colorant in a solvent such as ethyl acetate, adding the resulting solution to water including a dispersion stabilizer such as calcium carbonate in order to perform emulsification and suspension, after removing the solvent, removing the dispersion stabilizer, and filtering and drying the remaining particles.

The polymerized toner is prepared by, for example, adding a composition including a polymerizable monomer that constitutes a binder resin, a colorant, a polymerization initiator (e.g., benzoyl peroxide, lauroyl peroxide, isopropyl peroxycarbonate, cumene hydroperoxide, 2,4-dichlorobenzoyl peroxide, or methyl ethyl ketone peroxide), other additives, and the like to a water phase so as to form particles while the water phase is stirred, performing polymerization, and filtering and drying the resulting particles.

The proportions of materials of the toner, such as the urethane-modified acrylic resin, the other binder resin, the colorant, and other additives, may be set in consideration of the required properties, low-temperature fixability, color, and the like of the toner. The toner particles are pulverized in a carrier liquid with a known pulverizer such as a ball mill, a bead mill, or a high-pressure, wet-process atomizer. Thus, the toner used in the liquid developer according to this exemplary embodiment is produced.

In particular, the toner may be a pulverized toner.

Properties of Toner

The volume-average particle diameter $D_{50v}$ of the toner is preferably 0.2 μm or more and 6.0 μm or less, is more preferably 0.5 μm or more and 3.0 μm or less, and is further preferably 0.6 μm or more and 2.0 μm or less in order to form images having higher adhesion to recording media and enhance developing property.

The volume-average particle diameter $D_{50v}$, the number-average particle diameter distribution index (GSDp), the volume-average particle diameter distribution index (GSDv), and the like of the toner are measured with a laser-diffraction-scattering particle-diameter-distribution analyzer, such as a "LA-920" produced by HORIBA, Ltd. Specifically, the particle diameter distribution measured is divided into a number of particle diameter ranges (i.e., channels). For each range, in ascending order in terms of particle diameter, the cumulative volume and the cumulative number are calculated and plotted to draw cumulative distribution curves. Particle diameters at which the cumulative volume and the cumulative number reach 16% are considered to be the volume particle diameter $D_{16v}$ and the number particle diameter $D_{16p}$, respectively. Particle diameters at which the cumulative volume and the cumulative number reach 50% are considered to be the volume-average particle diameter $D_{50v}$ and the number-average particle diameter $D_{50}$p, respectively. Particle diameters at which the cumulative volume and the cumulative number reach 84% are considered to be the volume particle diameter $D_{84v}$ and the number particle diameter $D_{84p}$, respectively. On the basis of the volume particle diameters and number particle diameters measured, the volume-average particle diameter distribution index (GSDv) is calculated as $(D_{84v}/D_{16v})_{1/2}$ and the number-average particle diameter distribution index (GSDp) is calculated as $(D_{84p}/D_{16p})_{1/2}$.

Carrier Liquid

The liquid developer according to this exemplary embodiment includes a carrier liquid.

In the liquid developer, the carrier liquid serves as an insulating liquid in which toner particles are dispersed. Examples of the carrier liquid include, but are not limited to, aliphatic hydrocarbon solvents including an aliphatic hydrocarbon, such as a paraffin oil (as commercially available products, "MORESCO WHITE MT-30P", "MORESCO WHITE P40", and "MORESCO WHITE P70" produced by MATSUMURA OIL Co., Ltd. and "Isopar L" and "Isopar M" produced by Exxon Mobil Corporation); and hydrocarbon solvents such as a naphthenic oil (as commercially available products, "Exxsol D80", "Exxsol D110", and "Exxsol D130" produced by Exxon Mobil Corporation, and "Naphtesol L", "Naphtesol M", "Naphtesol H", "New Naphtesol 160", "New Naphtesol 200", "New Naphtesol 220", and "New Naphtesol MS-20P" produced by JX Nippon Oil & Energy Corporation).

Among the above carrier liquids, in particular, a mineral oil is preferably used, an aliphatic hydrocarbon solvent including an aliphatic hydrocarbon is more preferably used, and a branched aliphatic hydrocarbon solvent is particularly preferably used.

The term "mineral oil" used herein refers to a hydrocarbon that is in oil form at 25° C.

The liquid developer according to this exemplary embodiment may include only one carrier liquid or two or more carrier liquids. In the case where two or more carrier liquids are used in a mixture, for example, a paraffin solvent and a vegetable oil may be used in a mixture. Alternatively, a silicone solvent and a vegetable oil may also be used in a mixture.

The volume resistivity of the carrier liquid is preferably $1.0\times10^{10}$ Ω·cm or more and $1.0\times10^{14}$ Ω·cm or less and is more preferably $1.0\times10^{10}$ Ω·cm or more and $1.0\times10^{13}$ Ω·cm or less.

The content of the toner in the liquid developer according to this exemplary embodiment is preferably such that the amount of the toner is 0.5 to 40 parts by weight relative to 100 parts by weight of the carrier liquid and is more preferably such that the amount of the toner is 1 to 30 parts by weight relative to 100 parts by weight of the carrier liquid in order to, for example, control the viscosity of the liquid developer to be appropriate and thereby facilitate the circulation of the liquid developer in a developing device.

Additive

The liquid developer according to this exemplary embodiment may optionally include various types of additives such as a dispersant, an emulsifier, a surfactant, a stabilizer, a humectant, a thickener, a foaming agent, an antifoaming agent, a coagulant, a gelatinizer, an anti-settling agent, a charge-controlling agent, an antistatic agent, an antioxidant, a softener, a plasticizer, a filler, an oderant, an antitack agent, and a parting agent.

The above additives may be added to the carrier liquid.

Examples of the charge-controlling agent include, but are not limited to, the following charge-controlling agents known in the related art: positively chargeable charge-controlling agents such as a nigrosine dye, a fatty-acid-modified nigrosine dye, a carboxyl-group-containing, fatty-acid-modified nigrosine dye, a quaternary ammonium salt, an amine compound, an amide compound, an imide compound, and an organometal compound; and negatively chargeable charge-controlling agents such as a metal complex of an oxycarboxylic acid, a metal complex of an azo compound, a metal complex dye, and a salicylic acid derivative.

The liquid developer according to this exemplary embodiment may include a positively chargeable charge-controlling agent such as an amine charge-controlling agent "Solsperse13940/11200" produced by The Lubrizol Corporation and a pyrrolidone charge-controlling agent "AntaronV220" produced by International Specialty Products Inc.

The above charge-controlling agents may be used alone or in combination of two or more.

The content of the charge-controlling agent in the liquid developer according to this exemplary embodiment may be set such that the amount of the charge-controlling agent is 0.1 to 10 parts by weight relative to 100 parts by weight of the carrier liquid.

Method for Producing Liquid Developer

The liquid developer according to this exemplary embodiment is produced by mixing the toner with the carrier liquid with, for example, a disperser such as a ball mill, a sand mill, an Attritor, or a bead mill such that toner particles are dispersed in the carrier liquid. The method for dispersing toner particles in the carrier liquid is not limited to by using a disperser; for dispersing the toner particles in the carrier liquid, a special impeller may be rotated at a high speed as in a mixer, a shearing force produced by a rotor or a stator, which is known as a homogenizer, may be utilized, or an ultrasonic wave may be utilized.

The liquid developer according to this exemplary embodiment may also be produced by mixing coarse particles of the above-described toner with the carrier liquid, pulverizing the coarse toner particles in the presence of the carrier liquid with a ball mill or a bead mill into toner particles having a desired diameter, and dispersing the toner particles in the carrier liquid.

The resulting dispersion may optionally be, for example, filtered through a membrane filter having a pore size of about 100 μm in order to remove dust particles, coarse particles, and the like.

(2) Image Forming Method

The liquid developer according to the above-described exemplary embodiment may be used in an electrostatic-image-developing (i.e., electrophotographic) image forming method.

An image forming method according to another exemplary embodiment is an image forming method in which the liquid developer according to the above-described exemplary embodiment is used. In particular, the image forming method according to this exemplary embodiment may be a method including a latent-image forming step in which a latent image is formed on the surface of an image carrier; a developing step in which the latent image formed on the surface of the image carrier is developed with the liquid developer according to the above-described exemplary embodiment to form a toner image, the liquid developer being deposited on a developer carrier; a transfer step in which the toner image formed on the surface of the image carrier is transferred to a recording medium; and a fixing step in which the toner image transferred on the recording medium is fixed to the recording medium to form a fixed image.

The above steps are common as described in, for example, Japanese Unexamined Patent Application Publication No. 56-40868 and Japanese Unexamined Patent Application Publication No. 49-91231. The image forming method according to this exemplary embodiment may be implemented using a known image forming apparatus such as a copier or a facsimile.

The electrostatic latent-image forming step is a step in which an electrostatic latent image is formed on an image carrier (e.g., a photoreceptor).

For performing charging in order to form an electrostatic latent image, a charging method in which corona discharge is performed may be employed.

The developing step is a step in which the electrostatic latent image is developed with a developer layer disposed on the developer carrier to form a toner image. The developer layer is not limited as long as it includes the liquid developer according to the above-described exemplary embodiment.

The transfer step is a step in which the toner image is transferred to a body to which an image or the like is to be transferred. Examples of the body to which an image or the like is to be transferred in the transfer step include recording media such as an intermediate transfer body and a paper sheet.

The fixing step is a step in which the toner image transferred on a transfer paper sheet is fixed to the transfer paper sheet to form a copied image with, for example, a heating-roller fuser including a heating roller having a specific temperature.

The image forming method according to this exemplary embodiment may optionally include a cleaning step in which developer droplets that remain on the image carrier are removed.

The removal of the developer droplets may be done by, for example, using a cleaning blade.

The cleaning blade may be composed of a urethane rubber, a neoprene rubber, or a silicone rubber.

Known recording media may be used in the image forming method according to this exemplary embodiment. Examples of the recording media include paper sheets and OHP sheets that may be used in electrophotographic copiers, printers, and the like. In particular, coated paper sheets, which are produced by coating the surfaces of plain paper sheets with a resin or the like, printing art paper sheets, and the like may be used.

Among the above recording media, in particular, recording media including a surface layer composed of a polyester resin or a polyolefin resin may be used in order to enhance the effect of the image forming method according to this exemplary embodiment.

The image forming method according to this exemplary embodiment may optionally further include a recycle step. The recycle step is a step in which the electrostatic-image-developing toner particles recovered in the cleaning step are transported to the developer layer. Such an image forming method including the recycle step may be implemented using a toner-recycling image forming apparatus such as a copier or a facsimile. It is also possible to omit the cleaning step and apply this image forming method to a toner-recycling image forming apparatus in which recovery of toner particles is performed while an image is developed.

(3) Image Forming Apparatus

An image forming apparatus according to another exemplary embodiment includes a developing unit that develops an electrostatic latent image with the liquid developer according to the above-described exemplary embodiment in order to form a toner image. In particular, the image forming apparatus according to this exemplary embodiment may be an apparatus including an image carrier; a latent-image forming unit that forms a latent image on the surface of the image carrier; a developing unit that develops the latent image formed on the surface of the image carrier with the liquid developer according to the above-described exemplary embodiment in order to form a toner image, the liquid developer being deposited on the surface of a developer carrier; a transfer unit that transfers the toner image formed on the surface of the image carrier to a recording medium; and a fixing unit that fixes the toner image transferred on the recording medium to the recording medium in order to form a fixed image.

The image forming apparatus according to this exemplary embodiment is not limited as long as it includes at least the image carrier, the charging unit, the exposure unit, the developing unit, the transfer unit, and the fixing unit. The image forming apparatus according to this exemplary embodiment may optionally include a cleaning unit, a static-eliminating unit, and the like.

The transfer unit may perform transfer two or more times with an intermediate transfer body. Examples of a body to which an image or the like is to be transferred in the transfer unit include recording media such as an intermediate transfer body and a paper sheet.

The image carrier and the above units may have the structures described in the respective steps of the image forming method according to the above-described exemplary embodiment. The above units may be those of image forming apparatuses known in the related art. The image forming apparatus according to this exemplary embodiment may include units and devices other than those described above. In the image forming apparatus according to this exemplary embodiment, plural units may be operated simultaneously.

The charging unit may be a corona charging unit.

The image forming apparatus according to this exemplary embodiment may include a cleaning unit including a cleaning blade with which electrostatic-image developer droplets that remain on the image carrier are removed.

Examples of the cleaning unit include a cleaning blade and a cleaning brush.

An image forming apparatus including a liquid developer according to this exemplary embodiment is described below with reference to the attached drawing.

FIG. 1 schematically illustrates an example of the image forming apparatus according to this exemplary embodiment. An image forming apparatus 100 includes a photoreceptor (i.e., an image carrier) 10, a charging device (i.e., a charging unit) 20, an exposure device (i.e., a latent-image forming unit) 12, a developing device (i.e., a developing unit) 14, an intermediate transfer body (i.e., a transfer unit) 16, a cleaner (i.e., a cleaning unit) 18, and a transfer fixing roller (i.e., a transfer unit and a fixing unit) 28. The photoreceptor 10 is cylindrical and surrounded by the charging device 20, the exposure device 12, the developing device 14, the intermediate transfer body 16, and the cleaner 18, which are disposed on or above the outer periphery of the photoreceptor 10.

The action of the image forming apparatus 100 is described below.

The charging device 20 charges the surface of the photoreceptor 10 to a predetermined potential (charging step). The exposure device 12 exposes the charged surface of the photoreceptor 10 to a laser beam or the like on the basis of an image signal in order to form a latent image, that is, an electrostatic latent image (latent-image forming step).

The developing device 14 includes a developing roller 14*a* and a developer container 14*b*. The developing roller 14*a* is arranged to be partially immersed in a liquid developer 24 contained in the developer container 14*b*. The liquid developer 24 includes an insulating carrier liquid and a toner.

While toner particles have been dispersed in the liquid developer 24, for example, further stirring the liquid developer 24 with a stirrer disposed inside the developer container 14*b* reduces the spatial unevenness in the concentration of the toner particles in the liquid developer 24. As a result, the developing roller 14*a*, which rotates in the direction indicated by the arrow A in FIG. 1, is fed with the liquid developer 24, in which the unevenness in the concentration of toner particles has been reduced.

While the feeding rate at which the liquid developer 24 is fed to the photoreceptor 10 is limited to be within a specific range by a regulating member, the liquid developer 24 fed to the developing roller 14*a* is transported to the photoreceptor 10 and fed to an electrostatic latent image at the position at which the developing roller 14*a* comes close to or into contact with the photoreceptor 10. Thus, the electrostatic latent image is made visible to form a toner image 26 (developing step).

The developed toner image 26 is transported by the photoreceptor 10, which rotates in the direction indicated by the arrow B in FIG. 1, and transferred to a recording medium 30. In this exemplary embodiment, the toner image is transferred to an intermediate transfer body 16 before being transferred to the recording medium 30 (intermediate transfer step) in order to increase the efficiency with which the toner image is transferred to the recording medium as well as the efficiency with which the toner image is removed from the photoreceptor 10 and to fix the toner image to the recording medium simultaneously upon the toner image being transferred to the recording medium. There may be a difference in peripheral speed between the photoreceptor 10 and the intermediate transfer body 16.

The toner image transported by the intermediate transfer body 16 in the direction indicated by the arrow C in FIG. 1 is transferred and fixed to the recording medium 30 at the position at which the intermediate transfer body 16 comes into contact with the transfer fixing roller 28 (transfer step and fixing step). The transfer fixing roller 28 pinches the recording medium 30 together with the intermediate transfer body 16 such that the toner image transferred on the intermediate transfer body 16 comes into intimate contact with the recording medium 30. Thus, the toner mage is transferred and fixed to the recording medium 30 to form a fixed image 29. A heating element may be disposed on the transfer fixing roller 28 in order to fix the toner image by heating and pressing the toner image against the recording medium. The fixing temperature may be set to 120° C. or more and 200° C. or less.

In the case where the intermediate transfer body 16 has a roller-like shape as illustrated in FIG. 1, the intermediate transfer body 16 and the transfer fixing roller 28 constitute a pair of rollers and substantially serve as a fixing roller and a pressure roller in the fixing device, respectively, which enables fixation of images. Specifically, when the recording medium 30 is passed through a nip portion created between the intermediate transfer body 16 and the transfer fixing roller 28, the toner image is transferred and pressed against the intermediate transfer body 16 by the transfer fixing roller 28 while being heated. As a result, a fixed image 29 is formed on the recording medium 30.

While transfer and fixation of images to the recording medium 30 are performed simultaneously in this exemplary embodiment, the transfer step and the fixing step may be performed separately. That is, fixation of images may be performed subsequent to transfer of the images. In such a case, a transfer roller to which a toner image is transferred from the photoreceptor 10 substantially serves as an intermediate transfer body 16.

Toner particles that have not been transferred to the intermediate transfer body 16 and remain on the photoreceptor 10 after the transfer of the toner image 26 to the intermediate transfer body 16 are transported to the position at which the photoreceptor 10 comes into contact with the cleaner 18 and recovered with the cleaner 18. The cleaner 18 may be omitted in the case where the transfer efficiency is nearly 100% and toner particles that remain on the photoreceptor 10 hardly cause problems.

The image forming apparatus 100 may further include a static-eliminating device (not shown) that eliminates static charge on the surface of the photoreceptor 10 subsequent to the transfer step and prior to the next charging step.

The charging device 20, the exposure device 12, the developing device 14, the intermediate transfer body 16, the transfer fixing roller 28, the cleaner 18, and the like included in the image forming apparatus 100 may be all operated in synchronization with, for example, the speed of rotation of the photoreceptor 10.

(4) Developer Cartridge and Process Cartridge

A developer cartridge according to another exemplary embodiment includes at least the liquid developer according to the above-described exemplary embodiment.

A process cartridge according to this exemplary embodiment includes a developing unit that develops an electrostatic latent image formed on the surface of an image carrier with a liquid developer in order to form a toner image; and at least one selected from an image carrier, a charging unit that charges the surface of the image carrier, and a cleaning unit that removes toner particles that remain on the surface of the image carrier. The process cartridge according to this exemplary embodiment includes the liquid developer according to the above-described exemplary embodiment.

The developer cartridge according to this exemplary embodiment is not limited as long as it includes the liquid developer according to the above-described exemplary embodiment. The developer cartridge is detachably attachable to, for example, an image forming apparatus including a developing unit and includes the liquid developer according to the above-described exemplary embodiment which serves as a developer fed to the developing unit.

The developer cartridge and the process cartridge according to this exemplary embodiment may be detachably attachable to an image forming apparatus.

The process cartridge according to this exemplary embodiment may optionally include other units such as a static-eliminating unit.

The process cartridge may have a known structure. For example, the structures of the process cartridges described in Japanese Unexamined Patent Application Publication No. 2008-209489 and Japanese Unexamined Patent Application Publication No. 2008-203736 may be employed.

EXAMPLES

The foregoing exemplary embodiments are described more specifically in detail with reference to Examples and Comparative Examples below. However, the exemplary embodiments are not limited by Examples below. Note that all "parts" and "%" refer "parts by weight" and "% by weight", respectively, unless otherwise specified.

Details of the urethane-modified acrylic resins used in Examples and Comparative Examples are described below.

Urethane-Modified Acrylic Resin

8UA-146 (urethane-modified acrylic resin produced by Taisei Fine Chemical Co., Ltd., weight-average molecular weight (Mw): 30,000, urethane portion/acrylic portion=30/70 (by weight), glass-transition temperature (Tg) of acrylic portion: 82° C., urethane portion: polyester)

8UA-239H (urethane-modified acrylic resin produced by Taisei Fine Chemical Co., Ltd., Mw: 30,000, urethane portion/acrylic portion=20/80 (by weight), Tg of acrylic portion: 75° C., urethane portion: polyether)

8UA-017 (urethane-modified acrylic resin produced by Taisei Fine Chemical Co., Ltd., Mw: 40,000, urethane portion/acrylic portion=50/50 (by weight), Tg of acrylic portion: 50° C., urethane portion: polyether)

UA-1 (urethane-modified acrylic resin synthesized in the manner described below, Mw: 30,000, urethane portion/acrylic portion=12/88 (by weight), Tg of acrylic portion: 65° C., urethane portion: polyester)

UA-2 (urethane-modified acrylic resin synthesized in the manner described below, Mw: 32,000, urethane portion/acrylic portion=75/25 (by weight), Tg of acrylic portion: 65° C., urethane portion: polyester)

UA-3 (urethane-modified acrylic resin synthesized in the manner described below, Mw: 28,000, urethane portion/acrylic portion=5/95 (by weight), Tg of acrylic portion: 65° C., urethane portion: polyester)

UA-4 (urethane-modified acrylic resin synthesized in the manner described below, Mw: 35,000, urethane portion/acrylic portion=85/15 (by weight), Tg of acrylic portion: 65° C., urethane portion: polyester)

Synthesis of Acrylic Resin (A)

Into a flask equipped with a stirrer, a dropping funnel, a cooling pipe, and a thermometer, 300 parts by weight of methyl ethyl ketone (MEK) is charged. After the temperature has been increased to 110° C. under a stream of nitrogen, a mixed solution of 440 parts by weight of methyl methacrylate, 60 parts by weight of 2-hydroxyethyl methacrylate, and 3 parts by weight of azobisisobutyronitrile is charged into the dropping funnel and subsequently added dropwise to the flask under an increased pressure over 2 hours at a constant rate. Subsequently, 2 parts by weight of azobisisobutyronitrile and 100 parts by weight of MEK are charged into the dropping funnel and added dropwise to the flask under an increased pressure over 2 hours at a constant rate. The contents of the flask are aged (i.e., stirred at 110° C.) under an increased pressure for 3 hours and subsequently diluted with 100 parts by weight of MEK. Thus, an acrylic resin (A) including a hydroxyl group is synthesized.

Synthesis of Urethane Prepolymer (U)

Into a four-necked flask equipped with a thermometer, a stirrer, an inert-gas inlet, and a reflux condenser, 500.0 parts by weight of an alicyclic-structure-containing polyester polyol (hydroxyl value: 112.2 mgKOH/g), which is prepared by the reaction of 1,4-cyclohexanedimethanol with adipic acid, is charged. To the flask, 262.4 parts by weight of 4,4'-dicyclohexylmethane diisocyanate and 190.6 parts by weight of MEK are added. The resulting mixture is caused to react at 80° C. for 3 hours while the generation of heat is suppressed. Thus, a solution of a urethane prepolymer including an isocyanate group at the terminal is formed.

After the solution of a urethane prepolymer has been cooled to 40° C., it is mixed with 1,516.8 parts by weight of N,N-dimethylformamide and 567.8 parts by weight of MEK. The resulting mixture is further mixed with 76.8 parts by weight of isophoronediamine and subsequently caused to react at 60° C. for 3 hours. Thus, a solution of a urethane prepolymer (U) (weight-average molecular weight: 15,000) including an isocyanate group at the terminal is formed.

Synthesis of UA-1

Into a flask equipped with a stirrer, a dropping funnel, a cooling pipe, and a thermometer, 352 parts by weight of the acrylic resin (A) including a hydroxyl group, 48 parts by weight of the urethane prepolymer (U), 0.5 parts by weight of methoquinone (i.e., p-methoxyphenol), and 0.05 parts by weight of dioctyltin are charged. The resulting mixture is heated and caused to react at 80° C. for 8 hours under a mixed stream of nitrogen and oxygen.

After the disappearance of the peak corresponding to isocyanate groups has been confirmed with a Fourier transform infrared spectrophotometer (FT-IR), the contents of the flask are diluted with 650 parts by weight of MEK, and the reaction is terminated. Thus, a urethane-modified acrylic resin UA-1 having a urethane portion/acrylic portion ratio (by weight, hereinafter referred to as "U/A ratio") of 12/88 is synthesized.

Synthesis of UA-2

Into a flask equipped with a stirrer, a dropping funnel, a cooling pipe, and a thermometer, 100 parts by weight of the acrylic resin (A) including a hydroxyl group, 300 parts by weight of the urethane prepolymer (U), 0.5 parts by weight of methoquinone, and 0.05 parts by weight of dioctyltin are charged. The resulting mixture is heated and caused to react at 80° C. for 8 hours under a mixed stream of nitrogen and oxygen.

After the disappearance of the peak corresponding to isocyanate groups has been confirmed with a FT-IR, the contents of the flask are diluted with 650 parts by weight of MEK, and the reaction is terminated. Thus, a urethane-modified acrylic resin UA-2 having a U/A ratio of 75/25 is synthesized.

Synthesis of UA-3

Into a flask equipped with a stirrer, a dropping funnel, a cooling pipe, and a thermometer, 395 parts by weight of the acrylic resin (A) including a hydroxyl group, 20 parts by weight of the urethane prepolymer (U), 0.5 parts by weight of methoquinone, and 0.05 parts by weight of dioctyltin are charged. The resulting mixture is heated and caused to react at 80° C. for 8 hours under a mixed stream of nitrogen and oxygen.

After the disappearance of the peak corresponding to isocyanate groups has been confirmed with a FT-IR, the contents of the flask are diluted with 650 parts by weight of MEK, and the reaction is terminated. Thus, a urethane-modified acrylic resin UA-3 having a U/A ratio of 5/95 is synthesized.

Synthesis of UA-4

Into a flask equipped with a stirrer, a dropping funnel, a cooling pipe, and a thermometer, 60 parts by weight of the acrylic polymer (A) including a hydroxyl group, 340 parts by weight of the urethane prepolymer (U), 0.5 parts by weight of methoquinone, and 0.05 parts by weight of dioctyltin are charged. The resulting mixture is heated and caused to react at 80° C. for 8 hours under a mixed stream of nitrogen and oxygen.

After the disappearance of the peak corresponding to isocyanate groups has been confirmed with a FT-IR, the contents of the flask are diluted with 650 parts by weight of MEK, and the reaction is terminated. Thus, a urethane-modified acrylic resin UA-4 having a U/A ratio of 85/15 is synthesized.

Examples 1 to 11 and Comparative Examples 1 and 2

Synthesis of Non-Crystalline Polyester Resin

Into a heat-dried, two-necked flask, 200 parts by weight of dimethyl terephthalate, 85 parts by weight of 1,3-butanediol, and 0.3 parts by weight of dibutyltin oxide that serves as a catalyst are charged. Subsequently, the pressure inside the flask is reduced and the inside of the flask is purged with a nitrogen gas in order to replace the air contained in the flask with an inert atmosphere. The contents of the flask are mechanically stirred at 180 rpm for 5 hours and subsequently stirred for 2 hours under a reduced pressure while being gradually heated to 230° C. When the contents of the flask become viscous, they are air-cooled in order to stop the reaction. Thus, 240 parts by weight of a non-crystalline polyester resin, which includes an acid-derived component in which the content of an aromatic-dicarboxylic-acid-derived component is 100% by weight and an alcohol-derived component in which the content of an aliphatic-diol-derived component is 100% by weight, is synthesized.

The results of the measurement of molecular weight (in terms of polystyrene) by GPC confirm that the non-crystalline polyester resin (1) has a weight-average molecular weight (Mw) of 9,500 and a number-average molecular weight (Mn) of 4,200. In a DSC spectrum of the non-crystalline polyester resin (1) measured with a differential scanning calorimeter (DSC), clear peaks are not observed, but a stepwise change in the amount of heat absorbed is observed. The glass transition temperature of the non-crystalline polyester resin (1), which is considered to be the midpoint of the stepwise change in the amount of heat absorbed, is 55° C. The non-crystalline polyester resin (1) has an acid value of 18 mgKOH/g.

Kneading Step and Crushing Step

Preparation of Colorant Masterbatch

A resin material that is a polyester resin (Tg: 55° C., 100 parts by weight) is prepared.

The resin material is mixed with a colorant that is a cyan pigment (Pigment Blue 15:3, produced by Dainichiseika Color & Chemicals Mfg. Co., Ltd.) such that the weight ratio between the resin material and the colorant is 50:50. The resulting mixture is stirred with a Henschel mixer to form a raw material used in the production of toners.

This raw material (i.e., the mixture) is kneaded with a twin-screw knead extruder. The kneaded mixture extruded from an extrusion port of the twin-screw knead extruder is cooled.

The kneaded mixture that has been cooled in the above-described manner is crushed into coarse particles. Thus, a colorant masterbatch having an average particle diameter of 1.0 mm or less is prepared. For crushing the kneaded mixture into coarse particles, a hammer mill is used.

Colorant masterbatches that include a yellow pigment (C.I. Pigment Yellow 74, produced by Dainichiseika Color & Chemicals Mfg. Co., Ltd.), a magenta pigment (C.I. Pigment Red 269, produced by Dainichiseika Color & Chemicals Mfg. Co., Ltd.), and a black pigment (C.I. Pigment black 7, produced by Mitsubishi Chemical Corporation), respectively, are prepared as in the preparation of the colorant masterbatch that includes a cyan pigment.

Preparation of Crushed Material

Example 1

A mixture of 100 parts by weight of the colorant masterbatch, 100 parts by weight of the polyester resin, and 50 parts by weight of the urethane-modified acrylic resin "8UA-146" is kneaded with a twin-screw knead extruder. The kneaded mixture extruded from an extrusion port of the twin-screw knead extruder is cooled and subsequently crushed into coarse particles with a hammer mill. Thus, a crushed material is prepared.

Examples 2 to 11 and Comparative Examples 1 and 2

Crushed materials are prepared in Examples 2 to 11 and Comparative Examples 1 and 2 as described in Table 1, as in the preparation of the crushed material in Example 1.

For example, in Example 2, a mixture of 100 parts by weight of the colorant masterbatch, 125 parts by weight of the polyester resin, and 25 parts by weight of the urethane-modified acrylic resin "8UA-146" is kneaded with a twin-screw knead extruder. The kneaded mixture extruded from an extrusion port of the twin-screw knead extruder is cooled and subsequently crushed into coarse particles with a hammer mill. Thus, a crushed material is prepared.

In Comparative Example 2, a pulverization assistant "FTR2120" (a styrene-α-methylstyrene copolymer produced by Mitsui Chemicals, Inc., copolymerization molar ratio 1:1, Mw: 2,630) is added to the twin-screw knead extruder.

Wet Pulverization Step

Each of the crushed materials prepared by the above-described method and a carrier liquid that is a mineral oil "Isopar H" (isoparaffin hydrocarbon produced by Exxon Mobil Corporation) are charged into a ceramic pot. Zirconia balls having a diameter of 5 mm are charged into the ceramic pot at a volume filling percentage of 60%. Subsequently, wet pulverization is performed using a table pot mill at 300 rpm until the volume-average diameter ($D_{50}$) of the resulting toner particles reaches 1.0 μm. Thus, liquid developers of Examples 1 to 11 and Comparative Examples 1 and 2 are each prepared. Note that, preparation of a liquid developer is terminated if the pulverization step does not proceed.

Evaluation of Ease of Pulverizing Toner Particles (Productivity of Toner Particles)

Sample toner particles are taken from each of the pulverized materials that have been subjected to the wet pulverization step, and an evaluation of ease of pulverizing toner particles is made on the basis of the volume-average diameter ($D_{50}$) of the toner particles.

Good: The volume-average diameter ($D_{50}$) of the toner particles is 2 μm or less.

Fair: Pulverization proceeds until the volume-average diameter ($D_{50}$) of the toner particles reaches 2 to 3 μm and stops when the toner particles become flattened.

Poor: The volume-average diameter ($D_{50}$) of the toner particles is larger than 3 μm (i.e., pulverization does not proceed because toner particles predominantly become flattened).

Evaluation of Developing Property

A liquid-developer layer is formed on a developing roller of an image forming apparatus as illustrated in FIG. 1 with each of the liquid developers prepared in Examples 1 to 11 and Comparative Examples 1 and 2. The potential of the surface of the developing roller is set to 300 V. The surface of the photoreceptor is uniformly charged to a potential of 500 V. Subsequently, the surface of the photoreceptor is exposed to light in order to attenuate the charge on the surface of the photoreceptor. Thus, the potential of the surface of the photoreceptor is reduced to 50 V. Toner particles that remain on the developing roller and toner particles that remain on the photoreceptor are sampled with tapes at the position at which the liquid developer layer has been passed through clearance created between the photoreceptor and the developing roller. The tapes used for sampling the toner particles are stuck to a recording paper sheet, and the concentrations of the toner particles that remain on the developing roller and the toner particles that remain on the photoreceptor are measured. The concentration of the toner particles sampled on the photoreceptor divided by the sum of the concentration of the toner particles sampled on the photoreceptor and the concentration of the toner particles sampled on the developing roller and multiplied by 100 provides a quotient that is considered to be the developing efficiency, which is evaluated in accordance with the following criteria on a scale of A to E.

A: Developing efficiency is 96% or more; an excellent developing efficiency is confirmed.

B: Developing efficiency is 91% or more and less than 96%; a good developing efficiency is confirmed.

C: Developing efficiency is 85% or more and less than 91%; a developing efficiency that do not impair the practical use is confirmed.

D: Developing efficiency is 55% or more and less than 85%, a poor developing efficiency is confirmed.

E: Developing efficiency is less than 55%; a bad developing efficiency is confirmed.

Evaluation of Positively Charging Property

Measurement of a difference in potential is made for each of the liquid developers prepared in Examples and Comparative Examples with a microscopic laser zeta potential analyzer "ZC-3000" produced by MICROTEC CO., LTD. Evaluation is made in accordance with the following criteria on a scale of A to E. Specifically, each of the liquid developers is diluted with a diluent solvent, and the diluted liquid developer is charged into a transparent cell having a diameter of 10 mm. While a voltage of 300 V is applied between electrodes disposed at an interval of 9 mm, the velocity at which the particles migrate inside the cell is determined with a microscope. Subsequently, the zeta potential is calculated from the migration velocity.

A: The difference in potential is +100 mV or more (Excellent)

B: The difference in potential is +85 mV or more and less than +100 mV (Good)

C: The difference in potential is +70 mV or more and less than +85 mV (Fair)

D: The difference in potential is +50 mV or more and less than +70 mV (Poor)

E: The difference in potential is less than +50 mV (Bad)

Evaluation of Preservation Stability (Dispersion Stability)

Each (10 mL) of the liquid developers prepared in Examples 1 to 11 and Comparative Examples 1 and 2 is charged into a test tube (diameter: 12 mm, length: 120 mm) and left to stand for 14 days. Subsequently, the distance the liquid developer has settled in 14 days is measured and evaluated in accordance with the following criteria on a scale of A to E. Table 1 summarizes the results.

A: The distance the liquid developer has settled is 0 mm.

B: The distance the liquid developer has settled is more than 0 mm and 2 mm or less.

C: The distance the liquid developer has settled is more than 2 mm and 4 mm or less.

D: The distance the liquid developer has settled is more than 4 mm and 6 mm or less.

E: The distance the liquid developer has settled is more than 6 mm.

Evaluation of Adhesion: Tape Peeling Test

An image is formed on a polyethylene terephthalate (PET) film and a biaxially stretched polypropylene (OPP) film. Surfaces of the PET film and the OPP film on which the image is formed are each cut with a box cutter such that 11 slits that reach the base layer of the film are formed at intervals of 1 mm in each direction. Thus, a lattice pattern including 100 grids is formed on the PET and OPP films. To the grids, a Sellotape (registered trademark, cellophane adhesive tape, width: 24 mm, JIS 21522) is bonded at a high pressure by using an eraser. Subsequently, an end of the tape is pulled at a time at an angle of 45°.

Evaluation is Made in Accordance with the Following Criteria.

A: Peeling does not occur in any grid.

B: Peeling of the toner image slightly occurs at the intersections of the slits. The proportion of portions from which the toner image has been removed is clearly less than 5%.

C: Peeling of the toner image occurs along the slits and at the intersections of the slits. The proportion of portions from which the toner image has been removed is 5% or more and less than 15%.

D: Peeling of the toner image partially or entirely occurs along the slits. The proportion of portions from which the toner image has been removed is 15% or more and less than 65%.

TABLE 1

| | Carrier liquid | Urethane-modified acrylic resin Product name | Proportion of urethane portion [weight %] | Amount added [weight %] | Pulverization assistant Product name | Amount added [weight %] | Productivity | Developing property | Positively charging property | Dispersion stability | Adhesion PET | Adhesion OPP |
|---|---|---|---|---|---|---|---|---|---|---|---|---|
| Example 1 | Isopar H | 8UA-146 | 30 | 20 | — | — | Good | A | A | A | A | A |
| Example 2 | Isopar H | 8UA-146 | 30 | 10 | — | — | Good | B | B | B | B | B |
| Example 3 | Isopar H | 8UA-146 | 30 | 30 | — | — | Good | A | A | B | A | B |
| Example 4 | Isopar H | 8UA-239H | 20 | 20 | — | — | Good | A | A | B | B | B |
| Example 5 | Isopar H | 8UA-017 | 50 | 20 | — | — | Good | A | A | B | A | B |
| Example 6 | IsoparH | 8UA-146 | 30 | 5 | — | — | Good | B | C | B | C | B |
| Example 7 | Isopar H | 8UA-146 | 30 | 40 | — | — | Good | A | B | C | A | C |
| Example 8 | Isopar H | UA-1 | 12 | 20 | — | — | Good | B | C | C | C | B |
| Example 10 | Isopar H | UA-3 | 5 | 20 | — | — | Good | B | C | C | C | B |
| Example 11 | Isopar H | UA-4 | 85 | 20 | — | — | Fair | B | B | C | B | C |
| Comparative example 1 | Isopar H | — | — | — | — | — | Poor | E | E | E | D | D |
| Comparative example 2 | Isopar H | — | — | — | FTR2120 | 10 | Good | E | E | E | D | D |

Example 12

Preparation of Dispersant A

Into a reaction container equipped with a stirrer, a thermometer, and a gas-introduction pipe, 2,300 parts by weight of deionized water, 25 parts by weight of methyl methacrylate, and 75 parts by weight of 3-sodium sulfopropyl methacrylate are charged. A nitrogen gas is fed to the container for about 30 minutes. While the contents of the container are stirred, the temperature is increased to 60° C. Subsequently, 0.5 parts by weight of ammonium persulfate is added to the container. The resulting mixture is stirred for 3 hours and then cooled. Thus, a blue-white liquid containing a dispersant A having a solid content of 3.3% by weight and a viscosity of 340 mPa·s (25° C.) is prepared.

Preparation of Styrene-Acrylic Resin

Into a reaction container equipped with a stirrer and a thermometer, 160 parts by weight of deionized water, 0.04 parts by weight of an aqueous sodium polyacrylate solution (solid content: 3.3 weight %), 0.01 parts by weight of the dispersant A, and 0.4 parts by weight of sodium sulfate are charged. Subsequently, 80 parts by weight of styrene, 20 parts by weight of butyl acrylate, and 0.3 parts by weight of trimethylolpropane triacrylate, which serve as monomer components, and 2 parts by weight of benzoyl peroxide and 0.5 parts by weight of t-butylperoxy-2-ethylhexyl monocarbonate, that serve as polymerization initiators, are further added to the container. While the contents of the container are stirred, the temperature is increased from 40° C. to 130° C. over 65 minutes. After the temperature has reached 130° C., stirring is continued for another 2 hours 30 minutes and cooling is subsequently performed. Thus, a suspension of polymer particles is formed. The suspension is subjected to separation, cleaning, and drying processes to form a styrene-acrylic resin having a Tg of 55° C. and a weight-average molecular weight of 24,000.

Preparation of Colorant Masterbatch

A resin material that is the styrene-acrylic resin (Tg: 55° C., 100 parts by weight) is prepared.

The resin material is mixed with a colorant that is a cyan pigment (Pigment Blue 15:3, produced by Dainichiseika Color & Chemicals Mfg. Co., Ltd.) such that the weight ratio between the resin material and the colorant is 50:50. The resulting mixture is stirred with a Henschel mixer to form a raw material used in the production of toners.

This raw material (i.e., the mixture) is kneaded with a twin-screw knead extruder. The kneaded mixture extruded from an extrusion port of the twin-screw knead extruder is cooled.

The kneaded mixture that has been cooled in the above-described manner is crushed into coarse particles. Thus, a colorant masterbatch having an average particle diameter of 1.0 mm or less is prepared. For crushing the kneaded mixture into coarse particles, a hammer mill is used.

Colorant masterbatches that include a yellow pigment (C.I. Pigment Yellow 74, produced by Dainichiseika Color & Chemicals Mfg. Co., Ltd.), a magenta pigment (C.I. Pigment Red 269, produced by Dainichiseika Color & Chemicals Mfg. Co., Ltd.), and a black pigment (C.I. Pigment black 7, produced by Mitsubishi Chemical Corporation), respectively, are prepared as in the preparation of the colorant masterbatch that includes a cyan pigment.

A mixture of 100 parts by weight of the colorant masterbatch, 100 parts by weight of the styrene-acrylic resin, and 50 parts by weight of a urethane-modified acrylic resin "8UA-146" is kneaded with a twin-screw knead extruder. The kneaded mixture extruded from an extrusion port of the twin-screw knead extruder is cooled and subsequently crushed into coarse particles with a hammer mill. Thus, a crushed material is prepared.

The crushed material is subjected to the wet pulverization step as in Example 1. Thus, a liquid developer of Example 12 is prepared.

The liquid developer is subjected to the various evaluations as in Example 1. The evaluation results are summarized below.

Ease of Pulverizing Toner Particles: Good
Developing Property: C
Positively Charging Property: C
Dispersion Stability: C
Adhesion (PET): C
Adhesion (OPP): C

Comparative Example 3

Preparation of Polyurethane Resin

Into a separable flask, 600 parts by weight of succinic acid and 550 parts by weight of 1,4-butanediol are charged. After the system is heated to 100° C., 0.03 parts by weight of titanium tetraisopropoxide (Tipt) is added to the flask. While a dehydration reaction is conducted, the temperature of the system is set to 140° C., and the reaction is continued for 2 hours. Subsequently, the temperature of the system is increased to 220° C., and the reaction is continued. Thus, polyester diol having a weight-average molecular weight of 7,000 is prepared.

To the flask, 20 parts by weight of hexamethylene diisocyanate is added. While the resulting mixture is stirred under heating, 0.1 parts by weight of dibutyltin laurate is added to the flask. The contents of the flask are caused to react at 120° C. for 1 hour to form a thermoplastic polyurethane having a Tg of 50° C. and a weight-average molecular weight of 10,000.

Preparation of Colorant Masterbatch

A resin material that is the polyester resin (Tg: 55° C., 100 parts by weight) is prepared.

The resin material is mixed with a colorant that is a cyan pigment (Pigment Blue 15:3, produced by Dainichiseika Color & Chemicals Mfg. Co., Ltd.) such that the weight ratio between the resin material and the colorant is 50:50. The resulting mixture is stirred with a Henschel mixer to form a raw material used in the production of toners.

This raw material (i.e., the mixture) is kneaded with a twin-screw knead extruder. The kneaded mixture extruded from an extrusion port of the twin-screw knead extruder is cooled.

The kneaded mixture that has been cooled in the above-described manner is crushed into coarse particles. Thus, a colorant masterbatch having an average particle diameter of 1.0 mm or less is prepared. For crushing the kneaded mixture into coarse particles, a hammer mill is used.

Colorant masterbatches that include a yellow pigment (C.I. Pigment Yellow 74, produced by Dainichiseika Color & Chemicals Mfg. Co., Ltd.), a magenta pigment (C.I. Pigment Red 269, produced by Dainichiseika Color & Chemicals Mfg. Co., Ltd.), and a black pigment (C.I. Pigment black 7, produced by Mitsubishi Chemical Corporation), respectively, are prepared as in the preparation of the colorant masterbatch that includes a cyan pigment.

A mixture of 100 parts by weight of the colorant masterbatch, 100 parts by weight of the polyester resin, and 50 parts by weight of the polyurethane resin is kneaded with a twin-screw knead extruder. The kneaded mixture extruded from an extrusion port of the twin-screw knead extruder is cooled and subsequently crushed into coarse particles with a hammer mill. Thus, a crushed material is prepared.

The crushed material is subjected to the wet pulverization step as in Example 1. Thus, a liquid developer of Comparative Example 3 is prepared.

The liquid developer is subjected to the various evaluations as in Example 1. The evaluation results are summarized below.

Ease of Pulverizing Toner Particles: Poor
Developing Property: C
Positively Charging Property: C
Dispersion Stability: C
Adhesion (PET): B
Adhesion (OPP): B Comparative Example 4

Preparation of Colorant Masterbatch

A resin material that is the polyester resin (Tg: 55° C., 100 parts by weight) is prepared.

The resin material is mixed with a colorant that is a cyan pigment (Pigment Blue 15:3, produced by Dainichiseika Color & Chemicals Mfg. Co., Ltd.) such that the weight ratio between the resin material and the colorant is 50:50. The resulting mixture is stirred with a Henschel mixer to form a raw material used in the production of toners.

This raw material (i.e., the mixture) is kneaded with a twin-screw knead extruder. The kneaded mixture extruded from an extrusion port of the twin-screw knead extruder is cooled.

The kneaded mixture that has been cooled in the above-described manner is crushed into coarse particles. Thus, a colorant masterbatch having an average particle diameter of 1.0 mm or less is prepared. For crushing the kneaded mixture into coarse particles, a hammer mill is used.

Colorant masterbatches that include a yellow pigment (C.I. Pigment Yellow 74, produced by Dainichiseika Color & Chemicals Mfg. Co., Ltd.), a magenta pigment (C.I. Pigment Red 269, produced by Dainichiseika Color & Chemicals Mfg. Co., Ltd.), and a black pigment (C.I. Pigment black 7, produced by Mitsubishi Chemical Corporation), respectively, are prepared as in the preparation of the colorant masterbatch that includes a cyan pigment.

A mixture of 100 parts by weight of the colorant masterbatch, 100 parts by weight of the polyester resin, 25 parts by weight of the acrylic resin (A), and 25 parts by weight of the polyurethane resin is kneaded with a twin-screw knead extruder. The kneaded mixture extruded from an extrusion port of the twin-screw knead extruder is cooled and subsequently crushed into coarse particles with a hammer mill. Thus, a crushed material is prepared.

The crushed material is subjected to the wet pulverization step as in Example 1. Thus, a liquid developer of Comparative Example 4 is prepared.

The liquid developer is subjected to the various evaluations as in Example 1. The evaluation results are summarized below.

Ease of Pulverizing Toner Particles: Poor
Developing Property: C
Positively Charging Property: C
Dispersion Stability: D
Adhesion (PET): D
Adhesion (OPP): D The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A liquid developer comprising:
a carrier liquid; and
a toner including a urethane-modified acrylic resin.

2. The liquid developer according to claim 1,
wherein the urethane-modified acrylic resin is a graft polymer of an acrylic resin and a urethane resin.

3. The liquid developer according to claim 1,
wherein the urethane-modified acrylic resin is a graft polymer of an acryl resin and a polyester urethane resin.

4. The liquid developer according to claim 2,
wherein, in the graft polymer, a urethane chain is bonded to a side chain of the acrylic resin.

5. The liquid developer according to claim 1,
wherein the urethane-modified acrylic resin includes an acrylic portion constituted by a monomer having a reactive group.

6. The liquid developer according to claim 5,
wherein the acrylic portion has a glass-transition temperature Tg of 20° C. to 85° C.

7. The liquid developer according to claim 1,
wherein the urethane-modified acrylic resin includes a linear urethane portion.

8. The liquid developer according to claim 1,
wherein the urethane-modified acrylic resin has a weight-average molecular weight of 5,000 to 200,000.

9. The liquid developer according to claim 1,
wherein the urethane-modified acrylic resin includes a urethane portion and an acrylic portion at a weight ratio of 10/90 to 90/10.

10. The liquid developer according to claim 1,
wherein the toner includes another binder resin in an amount of 10% to 95% by weight of the total amount of the toner.

11. The liquid developer according to claim 10,
wherein the total amount of the urethane-modified acrylic resin and the other binder resin is 70% to 99% by weight of the total amount of the toner.

12. The liquid developer according to claim 1,
wherein the toner includes a colorant in an amount of 0.5% to 25% by weight of the total amount of the toner.

13. The liquid developer according to claim 1,
wherein the toner includes a parting agent in an amount of 0.1% to 10% by weight of the total amount of the toner.

14. The liquid developer according to claim 1,
wherein the toner includes inorganic particles in an amount of 0.1% to 10% by weight of the total amount of the toner.

15. The liquid developer according to claim 1,
wherein the carrier liquid includes a mineral oil.

16. The liquid developer according to claim 15,
wherein the carrier liquid has a volume resistivity of $1.0\times10^{10}$ Ω·cm or more and $1.0\times10^{14}$ Ω·cm or less.

17. The liquid developer according to claim 1,
wherein the amount of the toner including the urethane-modified acrylic resin is 0.5 to 40 parts by weight relative to 100 parts by weight of the carrier liquid.

18. A developer cartridge comprising the liquid developer according to claim 1.

* * * * *